United States Patent [19]

Lambertz et al.

[11] 4,030,160

[45] June 21, 1977

[54] CORNER BRACKET AND ROLLER ASSEMBLY FOR SLIDING DOORS

[75] Inventors: Martin R. Lambertz, New Hamburg; Maria Fiorelli, Kitchener, both of Canada

[73] Assignee: The Stanley Works, Hamilton, Canada

[22] Filed: July 19, 1976

[21] Appl. No.: 706,389

[30] Foreign Application Priority Data

Aug. 19, 1976 Canada ..... 233744

[52] U.S. Cl. ..... 16/105; 49/425

[51] Int. Cl.[2] ..... E05D 13/02

[58] Field of Search ..... 16/97, 98, 105, 106, 16/107, 32, 33, 45; 49/417, 425

[56] References Cited

UNITED STATES PATENTS

| | | | |
|---|---|---|---|
| 3,283,444 | 11/1966 | Andres | 16/105 X |
| 3,290,824 | 12/1966 | Anderson | 16/97 X |
| 3,299,575 | 1/1967 | DuShane | 16/97 X |
| 3,386,208 | 6/1968 | Banner | 16/105 X |
| 3,526,995 | 9/1970 | Saunders | 49/425 X |
| 3,716,890 | 2/1973 | Benson | 16/105 X |

*Primary Examiner*—Werner H. Schroeder
*Assistant Examiner*—Moshe I. Cohen
*Attorney, Agent, or Firm*—Richard J. Hicks

[57] ABSTRACT

A combined corner bracket and door roller assembly for use in a sliding metal patio screen door. The corner bracket is provided with first pivot means about which a roller assembly pivots during adjustment and in use. The roller assembly comprises a housing, a roller, a second pivot means for mounting the roller in the housing and an elongated curved resilient arm connected to the housing which provides for resilient mounting and adjustment of the roller assembly. The second pivot means is positioned between the first pivot means and the extreme outer vertical edge of the door so that the roller is positioned much closer to the vertical edge than in the prior art. By this device the wheel base of the door is maximized, the door is always resiliently mounted on the track, and the problem of track jumping is minimized.

12 Claims, 12 Drawing Figures

CORNER BRACKET AND ROLLER ASSEMBLY FOR SLIDING DOORS

This invention relates to a combined corner bracket and door roller assembly for use in a sliding metal screen door of the patio type.

Sliding patio screen doors, which are well-known, are generally fabricated from aluminum extrusions and designed to roll on a track which is an integral part of the threshold extrusion. Thus, the door is retained in appropriate grooves in both the jamb and header members of the frame. The average weight of a standard size screen door seldom exceeds 8 lbs and because of this relatively low weight, screen doors tend to jump out of their tracks. Various expedients to overcome this problem have been suggested and generally include some form of angular insert which is held in position either by friction, as in an interference fit, or by means of the screen door itself which is tensioned between the opposing rails. Various types of corner inserts have been provided which have a roller incorporated to permit vertical adjustment of the door. By raising or lowering the roller vertical and horizontal compensation for deviations in a fixed door frame can be provided, and such compensation is now mandatory for all Canadian government sponsored installations.

It is an object of the present invention to provide an alternative, low cost, combined angular insert and roller which substantially reduces the problem of track jumping.

Thus, by one aspect of this invention there is provided a corner bracket and roller assembly for a sliding door comprising: (a) a corner bracket having integral first and second arms at right angles adapted for insertion into frame members of said door; (b) first pivot means positioned in a plane perpendicular to said first arm and spaced from said second arm; (c) a roller assembly comprising (i) a housing, (ii) a roller, (iii) second pivot means mounting said roller in said housing, iv) an elongated resilient member connected to said housing and including adjustment means; said housing being adapted for insertion into said corner bracket, for pivotal mounting on said first pivot means, such that said roller is adjustably and resiliently extended through an aperture in an outside edge of said first arm adjacent an outside edge of said second arm, with said second pivot intermediate said first pivot means and said outside edge of said second arm, and wherein said adjustment means is adjusted through an aperture in said second arm.

In known corner inserts the roller is recessed approximately 4 inch from the extreme edges of the door. For a standard 3 foot 0 inch door this means a wheel base utilization factor of only 80.56 percent (36 − 7 = 29 inches) of the total available length. By incorporation of a corner insert and roller of the present invention the wheel base utilization factor is increased to 93.75 percent (36 −2.25 = 33.75 inches) of the total available length, because the roller is recessed only 1.125 inches from the extreme edges of the door. This factor alone is believed sufficient to overcome the tendency for the door to jump the track. The increase in wheel base utilization factor is achieved by the unique design of the insert-roller assembly of the present invention and the inherent resilience of the materials used in the fabrication of the roller assembly. It is particularly important that the roller pivot in the roller assembly be closer to the extreme outside edge of the door than the roller assembly pivot about which the roller assembly is adjusted relative to the corner assembly. Such a construction is the converse of the prior art assemblies.

Not only is the wheel base of the door lengthened by use of the roller of the present invention, but also the door is resiliently retained, at all times, between the upper and lower tracks without further manual adjustment. Such resiliency effectively absorbs any bulging or sagging in either track. A further advantage of the present invention is the ease of replacement of the roller or even the complete roller assembly without dismantling the door or the corner assembly thereof.

The principles and details of the present invention will become more apparent hereinafter when reference is made to the drawings in which.

Figure 5:
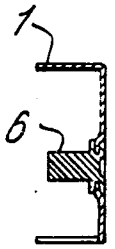
FIG. 5 is a sectional view, taken along line 5—5 of part of the corner bracket shown in FIG. 1.
Figure 3:
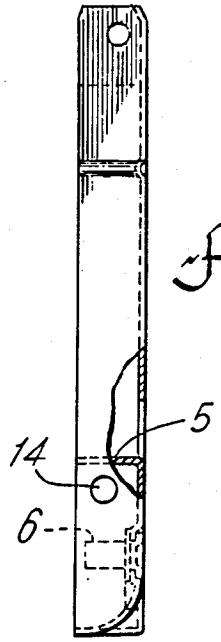
FIG. 3 is an end view of the corner bracket of FIG. 1.
Figure 1:
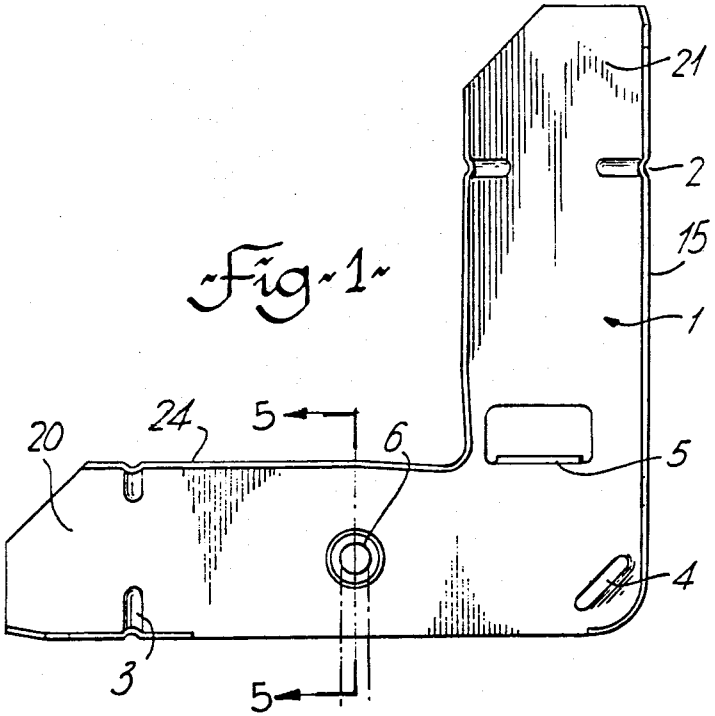
FIG. 1 is a side elevation of the corner bracket of the present invention.

Referring firstly to FIGS. 1, 3 and 5 there is shown a corner bracket 1, comprising first and second arms 20 and 21 at right angles which are designed to be inserted into the aluminum extrusions (not shown) of a conventional screen door frame, and to frictionally engage therewith by means of the sidewalls 24 thereof which are stabilized by pressed reinforcements 2 and 3. An embossing 4, to reinforce the bracket, may be provided. Bracket 1 is normally stamped from mild sheet steel in conventional manner. A locating projection 5 is lanced in arm 21 for a purpose described in more detail hereinbelow and a pivot pin 6 is secured to arm 20 by any convenient means, such as welding, staking or riveting.

Figure 6:
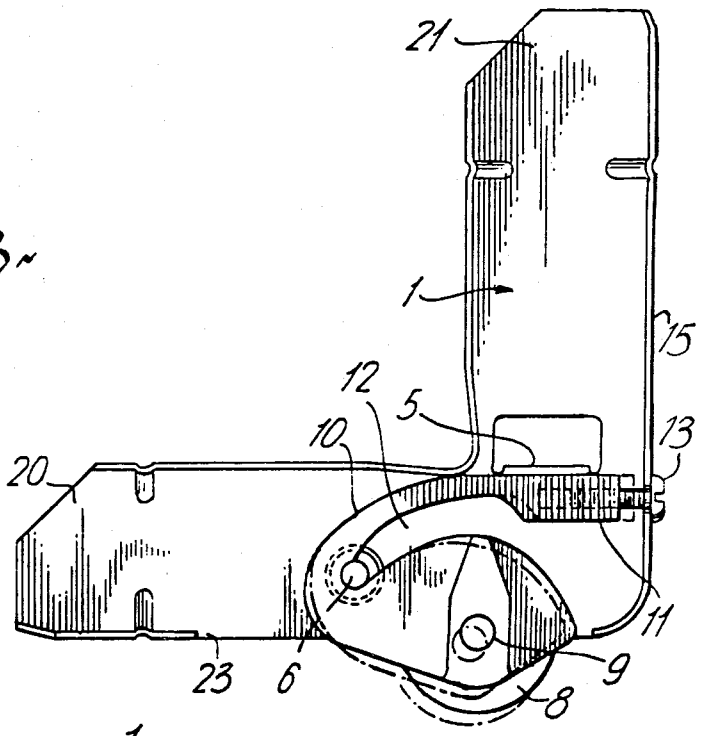
FIG. 6 is a side view of an assembled corner bracket of FIG. 1 and roller assembly of FIG. 2 according to the present invention.
Figure 4:
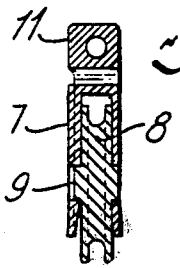
FIG. 4 is an end view of the roller assembly of FIG. 2, taken along section line 4—4.
Figure 2:
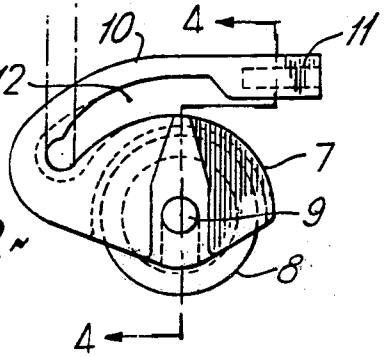
FIG. 2 is a side elevation of a roller assembly of one embodiment of the present invention.

Referring now to FIGS. 2 and 4, there is shown a roller housing 7 provided with a roller 8 and a pivot pin 9. Preferably the roller housing 7 and roller 8 are fabricated in a resilient thermoplastic material. Pin 9 may be integrally formed with roller 8 or may be separately formed. Housing 7 is provided with a resilient elongated curved arm 10 having a reinforced and internally cored portion 11 at the end thereof. Housing 7, roller 8, pivot 9 and arm 10 together form the roller assembly which is inserted into the corner bracket 1, as shown in FIG. 6, to project through an aperture 23 in arm 20 which is spaced from edge 15 by a distance of 0.75 – 4.0 inches, so that roller 8 is approximately 1.125 inches from the edge 15. Arm 10 forms a slot 12 with the main portion of housing 7 which is dimensioned to receive pivot pin 6 of bracket 1, as shown in FIG. 6. When housing 7 is inserted into bracket 1, a self-tapping screw 13 is inserted through hole 14 in arm 21 of bracket 1 and into a cored portion 11 of arm 10 to effect adjustment of the vertical height of roller 8. Projection 5 serves to locate and retain arm 10 relative to pin 6 and hole 14. As screw 13 is tightened the cored portion 11 is drawn toward hole 14 and housing 7 tends to pivot downwardly about pin 6, thereby lowering roller 8, as shown in dotted lines in FIG. 6. As housing 7 and its associated arm 10 is fabricated from a resilient material, preferably a thermoplastic polyamide material such as nylon, the curved arm is resilient and tends to straighten under load so as to maintain a downward pressure while pivoting around pivot pin 6 when used at the lower edge of a door, and to straighten by torquing of adjustment screw 13 when used at the upper edge of a door, and thus maintain tension on the door frame relative to the track in which roller 8 is moved. Because pin 6 is placed inwardly of the housing 7 relative to the outer edge 15 of arm 21, the housing is extremely compact and can be located extremely close to the extreme outer edge 15 of the corner bracket arm 21, thereby ensuring a maximum wheel base for the door. It will be appreciated that the unique design of the present invention insures resilient, as opposed to hard, mounting of the door at all times, and that vertical adjustment of roller 8 can be effected easily and at any time through an edge 15 of the door.

The simplicity of the present design offers the further benefit that the corner bracket assembly is symmetrical and can, therefore, be used for both left and right hand ends of the door. Inventory of parts required is therefore minimized and represents a considerable cost saving over other roller systems.

A preferred embodiment of the present invention has thus far been described but it will be appreciated that many modifications thereof are possible and a few of these will now be described with reference to FIGS. 7 to 12.

Figure 8:
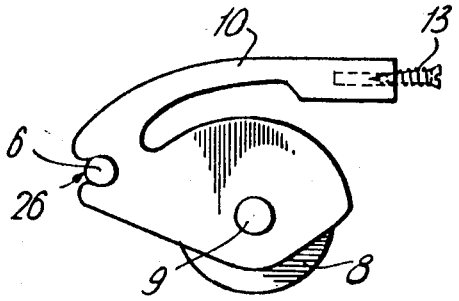
FIG. 8 is a side elevation of a modification of the embodiment shown in FIG. 7.
Figure 7:
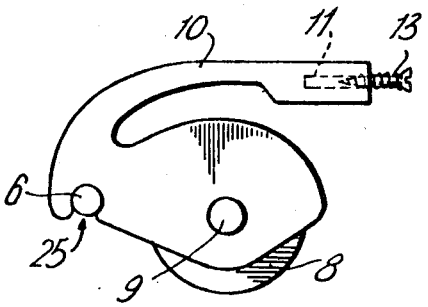
FIG. 7 is a side elevation of a second embodiment of the roller assembly of this invention.

FIGS. 7 and 8 show a minor modification of the integrally formed resilient housing 7 and arm 10 of FIG. 2, in which pivot pin 6 engages a slot 25 or 26, respectively, formed in the body of the housing, rather than the slot 12 between the body of the housing and arm 10 as in FIG. 2. In all other respects the function and operation of the device are the same.

Figure 9:
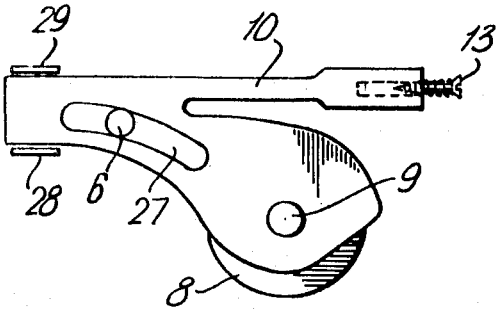
FIG. 9 is a side elevation of a third embodiment of the roller assembly of this invention.

In FIG. 9 there is shown an embodiment wherein housing 7 is modified to include a slot 27 in which a pivot pin 6 or other pivot means, such as a lanced projection from arm 20, is adapted to slide. Retainers 28 and 29 are lanced from arm 20 or otherwise provided to act as guides during adjustment of the roller housing by means of screw 13.

Figure 10:
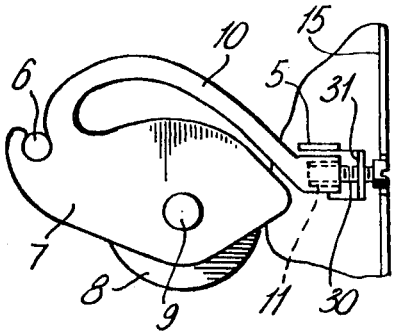
FIG. 10 is a side elevation of a fourth embodiment of this invention.

In FIG. 10 there is shown a more compact embodiment of the invention which is a further modification of the embodiment of FIGS. 7 and 8. The curved arm 10 is provided with a more pronounced curve and the housing 7 is angled more steeply to the vertical edge 15. The cored hole in portion 11 of arm 10 is made slightly larger than a flat-ended machine screw 30 which is inserted through outer edges 15 of arm 21 and a tapped lanced projection 31 from arm 21. As screw 30 is screwed through projection 31, the end thereof abuts the bottom of the cored hole in portion 11 thereby causing portion 11 to slide relative to lanced projection 5 and thus causing housing 7 to rotate about pivot 6 in a clockwise manner and arm 10 to assume an additionally curved form. As screw 30 is withdrawn, resilient arm 10 relaxes to its natural curved position and housing 7 rotates anti-clockwise about pivot pin 6.

Figure 11:
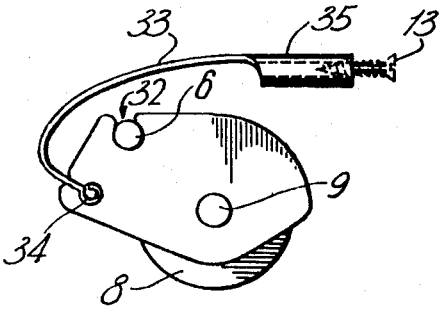
FIG. 11 is a side elevation of a fifth embodiment of this invention.
Figure 12:
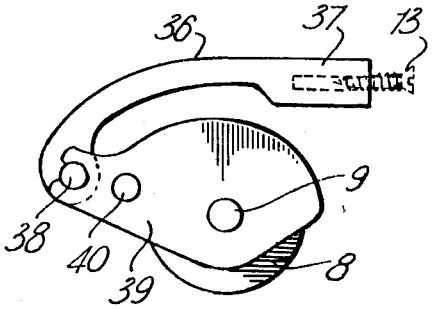
FIG. 12 is a side elevation of a further modification of the embodiment shown in FIG. 11.

In all of the foregoing embodiments of the invention, the curved arm 10 has been shown integrally with housing 7, but this is not an essential feature of the invention. FIGS. 11 and 12 show two embodiments wherein arm 10 and housing 7 are separately formed. In FIG. 11, housing 7 is provided with a slot 32 adapted to receive pivot pin 6 in a manner similar to that shown in FIGS. 6 and 8. Arm 10 is, however, replaced by a curved steel spring 33 secured, at one end 34,, to housing 7 by any convenient means such as riveting. The other end 35 of spring 33 is shaped to receive a self-tapping screw 13 (as in the embodiment of FIGS. 1–6) or is threaded to receive a machine screw (as in the embodiment of FIG. 10). Adjustment and resilient movement of the housing 7 is similar to that described hereinabove with reference to the preceding embodiments.

In FIG. 12, a curved steel arm 36 provided with screw adjustment means 37 is articulated at 38 to a steel housing 39 which is pivotally mounted on a pin 40. As adjustment means 37 is moved, as in the previous embodiments, housing 39 is caused to rotate about pin 40 thereby raising or lowering the roller 8. As tension is applied to the arm 36 it tends to straighten and thus resiliently forces roller 8 into contact with the track, as in the previous embodiments.

Many other embodiments will readily suggest themselves to those skilled in the art, without departing from the essential features of the present invention as defined in the claims appended hereto.

We claim:

1. A corner bracket and roller assembly for a sliding door comprising:
   a. a corner bracket having integral first and second arms at right angles adapted for insertion into frame members of said door; said first arm having an aperture in the bottom edge thereof; said second are having an outside edge adjacent said aperture;
   b. first pivot means secured in a plane perpendicular to said first arm and spaced from said second arm; and
   c. a roller assembly comprising
      i. a housing,
      ii. a roller,
      iii. second pivot means mounting to said roller in said housing, and
      iv. an elongated resilient member connected to said housing and including an adjustment means; said housing being inserted into said corner bracket, for pivotal mounting on said first pivot means such that said roller is adjustably and resiliently extended through said aperture of said first arm adjacent said outside edge of said second arm, with said second pivot means intermediate said first pivot means and said outside edge of said second arm, and wherein said adjustment means is adjusted through an aperture in said second arm.

2. An assembly as claimed in claim 1 wherein said elongated resilient member is integrally formed with said housing and is disposed thereover, thereby forming a slot adapted to receive said first pivot means.

3. An assembly as claimed in claim 1 wherein a slot is incorporated in said elongated resilient member and is adapted to receive said first pivot means.

4. An assembly as claimed in claim 1 wherein said housing includes recess means for pivotally receiving said first pivot means.

5. An assembly as claimed in claim 1 wherein said first pivot means comprises a pivot pin rigidly mounted on said first arm.

6. An assembly as claimed in claim 3 wherein said first pivot means comprises a lanced projection from said first arm.

7. An assembly as claimed in claim 1 wherein said adjustment means includes an internally cored end in said elongated member and a threaded screw member which may be inserted through said second arm into said cored end.

8. An assembly as claimed in claim 1 wherein said elongated resilient member comprises a spring member articulated to said housing.

9. An assembly as claimed in claim 1 wherein said roller assembly is fabricated from a resilient thermoplastic material.

10. An assembly as claimed in claim 1 wherein said roller assembly is fabricated from nylon.

11. An assembly as claimed in claim 1 wherein said aperture in said first arm is spaced from said outside edge of said second arm by an amount in the range 0.75 to 4.0 inches.

12. An assembly as claimed in claim 1 wherein said roller is spaced from said outside edge of said second arm by a distance of about 1.125 inches.

* * * * *

UNITED STATES PATENT AND TRADEMARK OFFICE

CERTIFICATE OF CORRECTION

PATENT NO. : 4,030,160

DATED : June 21, 1977

INVENTOR(S) : Martin R. Lambertz and Maria Fiorelli

It is certified that error appears in the above-identified patent and that said Letters Patent are hereby corrected as shown below:

Patentee's corresponding Canadian Application 233,744 was filed August 19, 1975 and not August 19, 1976 as indicated on the cover page of the patent.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*